US007686244B2

(12) United States Patent
Ando et al.

(10) Patent No.: US 7,686,244 B2
(45) Date of Patent: Mar. 30, 2010

(54) PAPER ROLL FEED MECHANISM, PAPER ROLL FEED CASSETTE, AND IMAGE FORMING APPARATUS

(75) Inventors: Hideki Ando, Kanagawa (JP); Katsuhisa Ono, Tokyo (JP)

(73) Assignee: Sony Corporation, Tokyo (JP)

( * ) Notice: Subject to any disclaimer, the term of this patent is extended or adjusted under 35 U.S.C. 154(b) by 593 days.

(21) Appl. No.: 11/609,083

(22) Filed: Dec. 11, 2006

(65) Prior Publication Data

US 2007/0147936 A1 Jun. 28, 2007

(30) Foreign Application Priority Data

Dec. 15, 2005 (JP) ..... P2005-362399

(51) Int. Cl.
*B65H 23/00* (2006.01)

(52) U.S. Cl. ..... 242/566; 242/598; 400/242

(58) Field of Classification Search ..... 242/348, 242/348.3, 348.4, 342, 588.5, 538.4, 564.5, 242/542.3, 535.4, 595, 566, 563, 563.1, 598, 242/598.3, 598.5; 400/242, 244, 691, 693, 400/693.1; 226/171, 172

See application file for complete search history.

(56) References Cited

U.S. PATENT DOCUMENTS

| | | | | |
|---|---|---|---|---|
| 6,206,318 | B1 * | 3/2001 | Glass | 242/400.1 |
| 6,250,578 | B1 * | 6/2001 | Manda | 242/378.1 |
| 6,345,782 | B1 * | 2/2002 | Nakayama et al. | 242/564.4 |
| 6,367,727 | B1 * | 4/2002 | Sasou et al. | 242/348.1 |
| 6,450,383 | B2 * | 9/2002 | Crowley et al. | 226/31 |
| 7,156,340 | B2 * | 1/2007 | Shiraishi et al. | 242/555.5 |
| 2001/0007621 | A1 | 7/2001 | Mogi | |
| 2001/0008596 | A1 | 7/2001 | Mogi | |

FOREIGN PATENT DOCUMENTS

| | | |
|---|---|---|
| EP | 1342579 | 9/2003 |
| JP | 09-255196 | 9/1997 |
| JP | 2002-053231 | 2/2002 |
| JP | 2005-262585 | 9/2005 |
| JP | 2005262585 | 9/2005 |

OTHER PUBLICATIONS

European Patent Office Search Report corresponding to European Serial No. 06256357.2; Apr. 4, 2007; 8 pages.

* cited by examiner

*Primary Examiner*—William A Rivera
(74) *Attorney, Agent, or Firm*—Sonnenschein Nath & Rosenthal LLP

(57) ABSTRACT

A paper roll feed mechanism rotates a paper roll including recording paper wound in a cylindrical shape to unwind the paper. The paper roll feed mechanism includes the following components. A supporting mechanism rotatably supports the paper roll. At least one paper feed roller unwinds the paper, serving as the outer surface of the paper roll supported by the supporting mechanism, in the lengthwise direction of the paper. A skew correcting member presses a side surface of the paper roll, supported by the supporting mechanism, in the widthwise direction of the paper. The skew correcting member presses outer part of the side surface of the paper roll in a paper unwinding region.

7 Claims, 14 Drawing Sheets

PAPER ROLL FEED MECHANISM, PAPER ROLL FEED CASSETTE, AND IMAGE FORMING APPARATUS

CROSS REFERENCES TO RELATED APPLICATIONS

The present invention contains subject matter related to Japanese Patent Application JP 2006-362399 filed in the Japanese Patent Office on Dec. 15, 2005, the entire contents of which are incorporated herein by reference.

BACKGROUND OF THE INVENTION

1. Field of the Invention

The present invention relates to a paper roll feed mechanism capable of correcting skew of paper unwound from a paper roll, a paper roll feed cassette using the paper roll feed mechanism, and an image forming apparatus using the paper roll feed mechanism and the paper roll feed cassette.

2. Description of the Related Art

A thermal printer using a thermal head opposed to a platen is known as one of image forming apparatuses. As digital cameras become increasingly popular, rolls of paper are widely used as recording paper serving as printing media for thermal printers. A roll of paper (i.e., a paper roll) is cost-effective in high-quality photographic printing.

A paper roll includes a long sheet of recording paper wound in a cylindrical shape. Paper rolls are classified into two types: The first type is a paper roll including paper wound on a paper tube, serving as a winding core. The second type is a paper roll including paper wound with no winding core (the second type paper roll will be called a core-free paper roll hereinafter). Both the types are used as follows: A necessary amount of paper is unwounded from a paper roll and is moved to a thermal head every printing. After printing, the printed paper is cut into a sheet having a predetermined size.

In a thermal recording technique of directly printing an image onto thermosensitive paper of a paper roll, respective colors of thermosensitive color-developing layers formed in the paper are sequentially developed, thus forming a full-color image.

In a thermal transfer recording technique of printing an image on a paper roll using ink ribbons of three colors, i.e., yellow, magenta, and cyan, solid inks on the respective ink ribbons are thermally transferred to paper, thus forming a full-color image.

Such color-capable thermal printers include a three-pass one-head type and a one-pass three-head type. In the three-pass one-head type thermal printer, paper feed and return is repeated three times in such a manner that paper unwound from a paper roll is moved forward and backward so as to pass through nip between one thermal head and a platen, thus printing a color image on the paper. In the one-pass three-head type thermal printer, paper unwound from a paper roll is moved once so as to pass through nip between each thermal head and a platen, thus printing a color image. As for monochrome printing, a one-pass one-head type thermal printer may be used.

In printing using a thermal printer, therefore, paper unwounded from a paper roll by a paper feed roller is allowed to pass through nip between a thermal head and a platen three times or once. To allow the paper to pass therethrough, it is necessary to move the thermal head away from the platen, i.e., retract the thermal head. In other words, in the thermal printer, the thermal head is temporarily retracted and the paper is fed. After the paper reaches under the thermal head, the thermal head is pressed against the paper (or the ink ribbon on the paper) on the platen and the paper (or the ink ribbon on the paper) is conveyed while heating elements of the thermal head are generating heat, thus printing an image on the paper.

After printing, the thermal head is again retracted, the printed paper is fed and cut into a sheet with a predetermined size, and the sheet is ejected. In the three-pass one-head type, after printing, the thermal head is retracted, the paper is returned, and printing is again performed. This operation is repeated.

As described above, paper unwound from the paper roll is fed to the thermal head every printing, and after printing, the printed paper is cut into a sheet. Disadvantageously, if paper is not unwounded straight from a paper roll, i.e., the paper is skewed, the skew affects subsequent operations, causing paper jamming or poor printing.

To overcome the disadvantages, various techniques of preventing skew are proposed. For example, Japanese Unexamined Patent Application Publication No. 2005-262585 (Patent Document 1) discloses a printer using one of the various techniques. In this printer, a spring-urged pressure aligning plate is brought into contact with one side edge of paper unwounded from a paper roll to press the paper against an opposed fixed aligning plate, thus correcting skew.

Japanese Unexamined Patent Application Publication No. 9-255196 (Patent Document 2) discloses a deskewing structure using a U-shaped bar. This bar is put on the outer surface of a paper roll such that both sides of the bar control the position of the paper roll in the widthwise direction thereof. In this deskewing structure, if the outer diameter of the paper roll is changed, the bar is swung in response to the change in outer diameter. The position of the paper roll in the widthwise direction, therefore, is continuously controlled, thus preventing skew of paper.

Japanese Unexamined Patent Application Publication No. 2002-53231 (Patent Document 3) discloses a paper feed cassette capable of deskewing sheets. A pressure contact member having an inclined contact surface is spring-urged against side edges of cut sheets stacked in the cassette, thus preventing skew of each sheet. Since the pressure contact member is in contact with the uppermost cut sheet, the sheet is prevented from skewing even when the amount of remaining sheets is small.

SUMMARY OF THE INVENTION

The technique disclosed in Patent Document 1 has disadvantages in that the side surface of the paper roll may easily become dirty or be damaged, leading to an increase or variation of load on paper feeding. As for the amount of skew caused during unwinding paper from the paper roll, generally, the amount of skew in downstream part of the unwound paper becomes larger than that in the leading edge thereof. In order to correct skew using the pressure aligning plate located far away from a region where paper is unwounded from the paper roll as described in Patent Document 1, it is necessary to apply a large pressure to a side surface of the paper roll. Unfortunately, the side surface of the paper roll may become dirty or be damaged, leading to an increase or variation of load during paper feeding.

According to a technique disclosed in Patent Document 2, in some cases, skew of paper unwound from the paper roll is not prevented, resulting in a reduction in reliability. Since a paper roll varies in width, the distance between the side portions of the bar has to be larger than the paper width including a maximum dimension error. Unfortunately, even if the paper width is small, although the width is within the error range, a clearance exists between each side surface of the paper roll and the corresponding side portion of the bar. Disadvantageously, the position of the paper roll in the widthwise direction is not controlled, so that paper may be skewed.

A technique disclosed in Patent Document 3 is applied to a stack of cut sheets stored in the paper feed cassette. It is, therefore, difficult to apply this technique to a paper roll containing recording paper wound in a cylindrical shape, the recording paper, serving as the outer surface of the paper roll, being sequentially unwound in the lengthwise direction thereof from the paper roll by rotating the paper roll.

Particularly, the amount of skew of paper unwound from a paper roll is gradually increased, unlike the case of cut sheets. If a printer does not include a skew correcting unit adapted for a paper roll, the paper roll is temporarily removed from the interior of the printer and is again mounted to the printer so that paper is unwound straight without skew. The use of a paper roll, therefore, needs a technique for dealing with problems specific to a paper roll, e.g., the adverse effect of skew on subsequent operations.

Paper rolls are widely used because a paper roll is more cost-effective than cut sheets in high-volume photographic printing. Accordingly, the number of compatible printers is remarkably increased. An important challenge is, therefore, to prevent skew of paper unwound from a paper roll.

It is desirable to reliably prevent skew of paper unwound from a paper roll without causing dirt or damage on the paper roll and causing an increase or variation in load during paper feeding so that paper jamming or poor printing is not caused.

According to an embodiment of the present invention, there is provided a paper roll feed mechanism that rotates a paper roll including recording paper wound in a cylindrical shape to unwind the paper. The paper roll feed mechanism includes the following components. A supporting mechanism rotatably supports the paper roll. At least one paper feed roller unwinds the paper, serving as the outer surface of the paper roll supported by the supporting mechanism, in the lengthwise direction of the paper. A skew correcting member presses a side surface of the paper roll, supported by the supporting mechanism, in the widthwise direction of the paper. The skew correcting member presses outer part of the side surface of the paper roll in a paper unwinding region.

According to this embodiment, the skew correcting member pressing one side surface of the paper roll in the widthwise direction thereof is arranged such that the skew correcting member presses the outer part of the side surface of the paper roll in the paper unwinding region. Consequently, the side surface of the paper roll is restricted by the skew correcting member during unwinding the paper from the paper roll, thus preventing skew of the paper.

According to the embodiment of the present invention, the side surface of the paper roll is restricted by the skew correcting member during unwinding the paper from the paper roll, so that the paper can be prevented from skewing. In the use of a paper roll, paper can be stably fed, thus solving problems, such as paper jamming and poor printing.

DESCRIPTION OF THE PREFERRED EMBODIMENTS

An embodiment of the present invention will be described below with reference to the drawings.

A paper roll feed mechanism according to the embodiment of the present invention is applied to a paper roll feed cassette. The paper roll feed cassette receiving a paper roll is mounted to a thermal printer, serving as an image forming apparatus.

Figure 1:
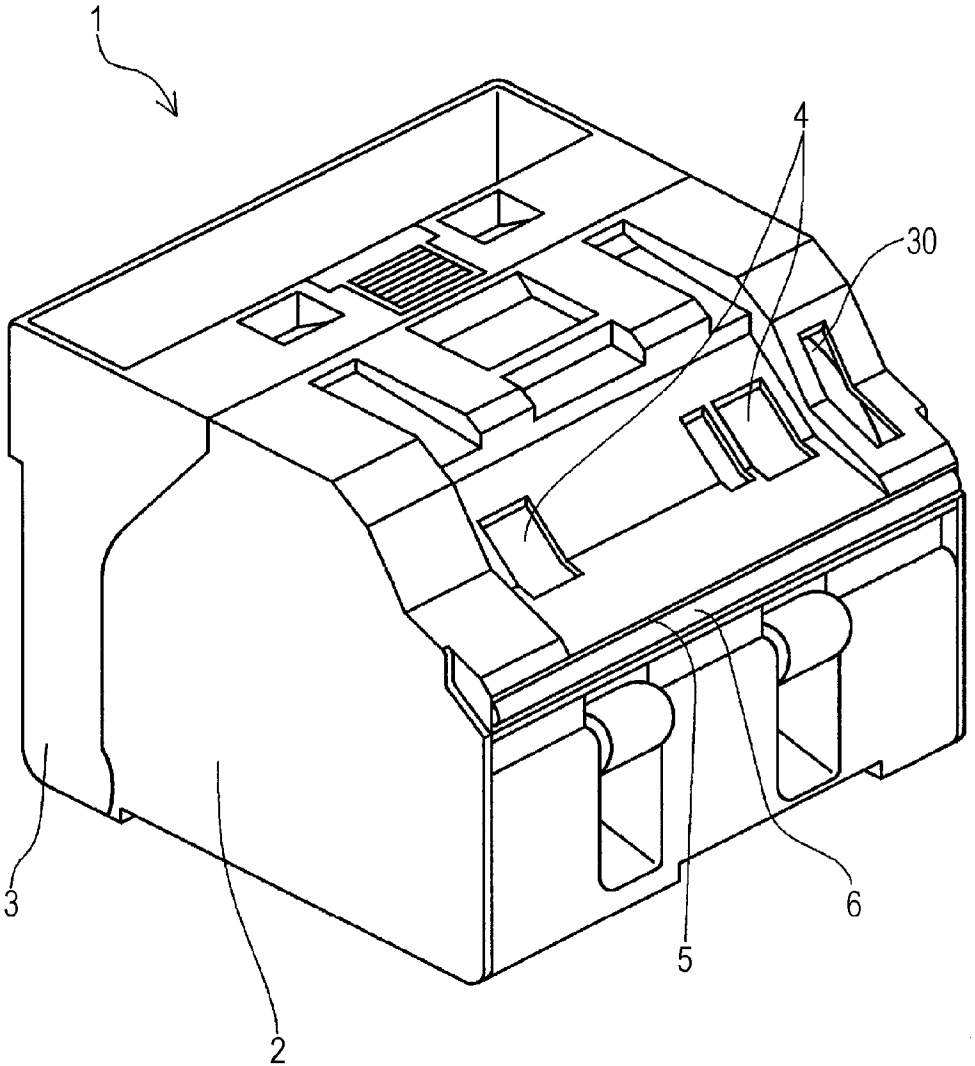
FIG. 1 is a perspective view of a paper roll feed cassette according to an embodiment of the present invention, FIG. 1 showing a paper feeding side of the cassette.

FIG. 1 is a perspective view of a paper roll feed cassette 1 according to the present embodiment. In this figure, a paper feeding side of the cassette 1 is shown.

Figure 2:
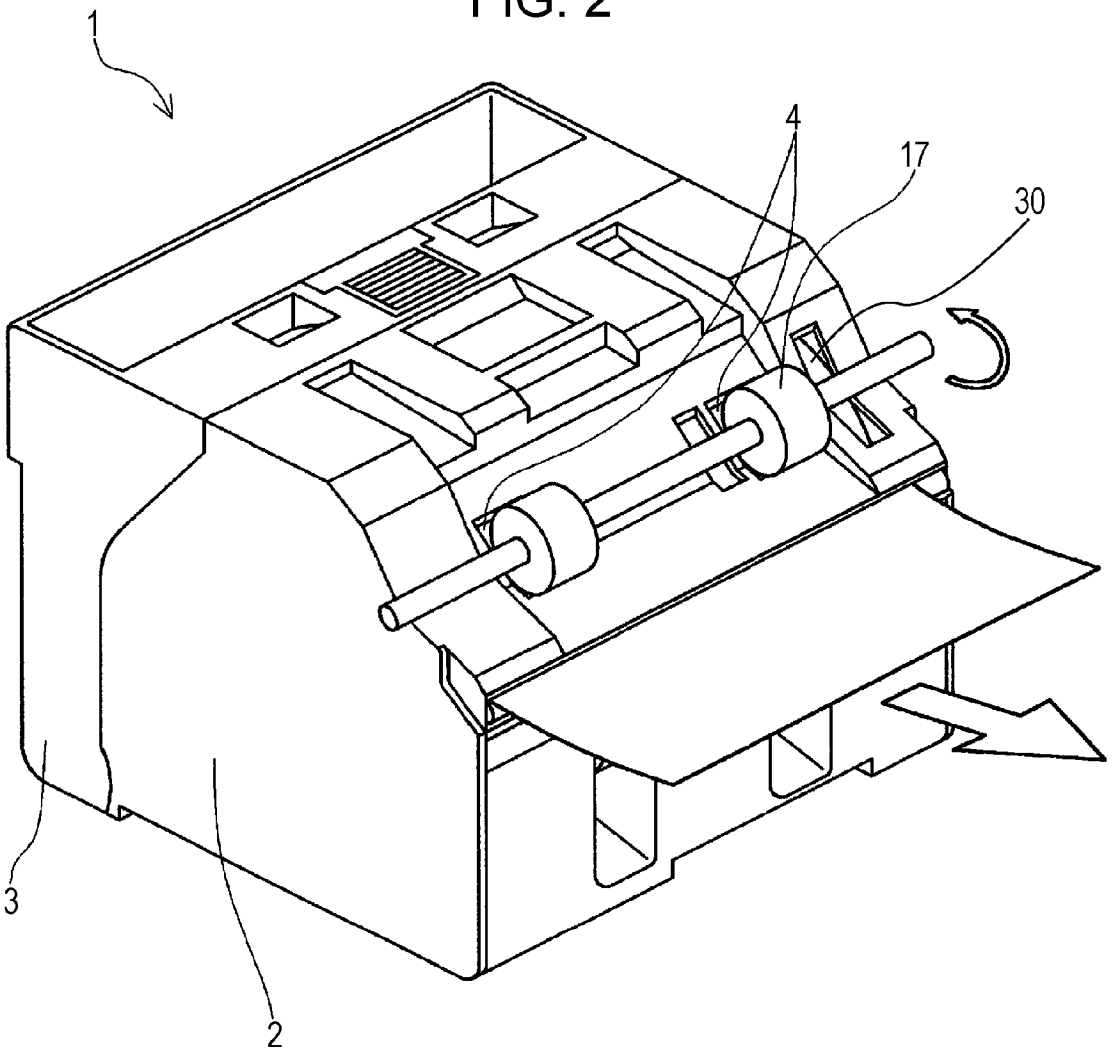
FIG. 2 is a perspective view showing a state in which paper feed rollers of a thermal printer are pressed into contact with a paper roll in the paper roll feed cassette shown in FIG. 1.

FIG. 2 is a perspective view showing a state in which paper feed rollers 17 of the thermal printer are pressed into contact with a paper roll in the paper roll feed cassette 1.

Referring to FIGS. 1 and 2, the paper roll feed cassette 1 is a hard resin casing and includes a cassette body 2 and a lid 3 attached to the cassette body 2. A paper roll 30 is received in the paper roll feed cassette 1.

Receiving the paper roll 30 in the paper roll feed cassette 1 reflects consideration of the usability of the paper roll 30 in loading. In the thermal printer using the paper roll 30, when the paper roll 30 is used out, it is necessary to load a new paper roll 30. If the thermal printer is another type in which the paper roll feed cassette 1 is not used and the new paper roll 30 is inserted into a load opening of the thermal printer and a cover of the printer is closed after aligning the paper roll 30, the paper roll 30 may be brought in contact with internal components of the thermal printer, damaging the components.

To avoid the above-described problem, the paper roll feed cassette 1 according to the present embodiment is used. A user can easily load the paper roll 30 into the paper roll feed cassette 1 and then mount the cassette 1 to the thermal printer, thus preventing a mechanical failure or dirt on the thermal printer and increasing safety. This results in an acceleration in loading operation. The use of the paper roll feed cassette 1 according to the present embodiment reduces the burden of loading the paper roll 30.

The cassette body 2 of the paper roll feed cassette 1 has openings 4 through which the paper feed rollers 17 are pressed into contact with the paper roll 30 received in the cassette body 2. In other words, when the paper roll feed cassette 1 receiving the paper roll 30 is mounted to the thermal printer, the paper feed rollers 17 attached in the thermal printer are pressed into contact with the outer surface of the paper roll 30 through the respective openings 4 as shown in FIG. 2.

The cassette body 2 has a feed opening 5 under the openings 4. Paper unwound from the paper roll 30 passes through the feed opening 5 from the interior of the cassette body 2. The leading edge of paper unwound from the paper roll 30 is ejected from the feed opening 5 in the lengthwise direction of paper of the paper roll 30 as shown by the arrow of FIG. 2. A cylindrical cleaner 6 is attached to the feed opening 5. The cleaner 6 is in contact with a recording surface (in the present embodiment, inner surface) of paper of the paper roll 30 to remove attached foreign matter, such as dirt or dust. The cleaner 6 includes a flap (not shown) standing in a direction opposite to the direction of ejecting the leading edge of paper of the paper roll 30 from the feed opening 5.

Figure 3:
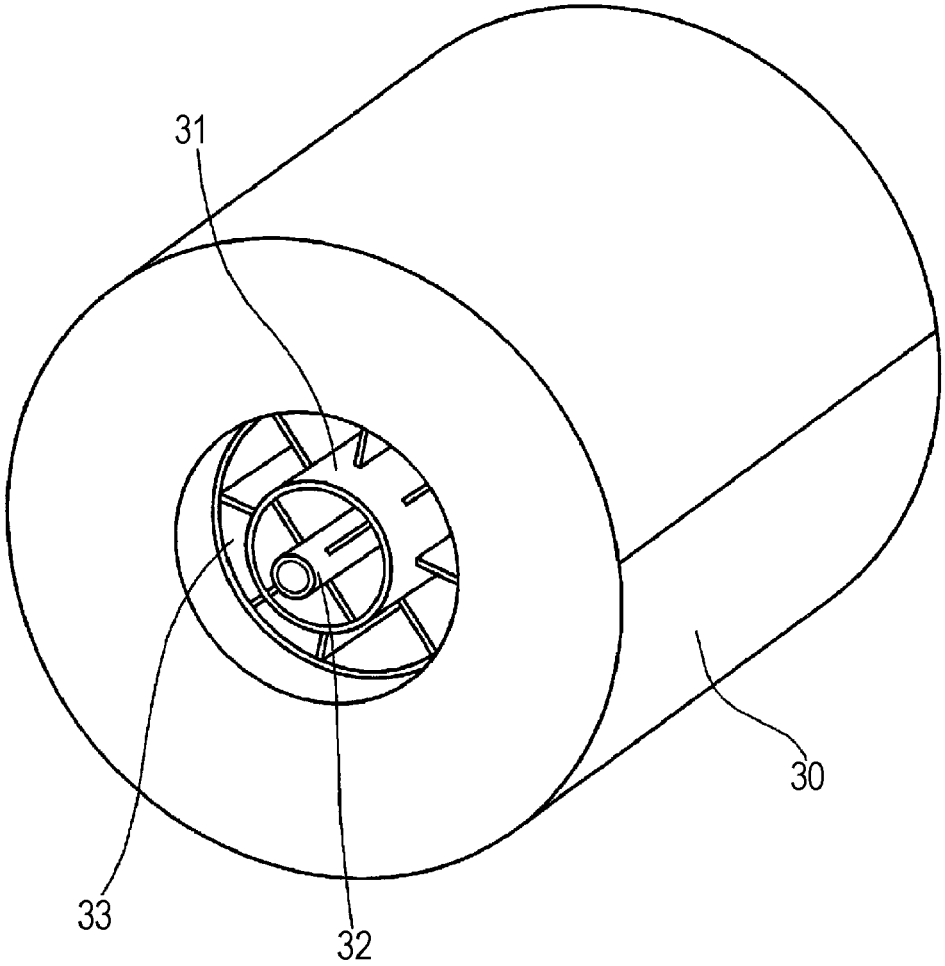
FIG. 3 is a perspective view of a paper roll to be received in the paper roll feed cassette according to the present embodiment.

FIG. 3 is a perspective view of the paper roll 30 to be received in the paper roll feed cassette 1 according to the present embodiment.

Referring to FIG. 3, the paper roll 30 contains recording paper wound in a cylindrical shape with no winding core. To attach the paper roll 30 into the paper roll feed cassette 1, a paper holder 31 is inserted into a center hole defining the inner surface of the paper roll 30.

The paper holder 31 has a shaft 32 supported by a supporting mechanism, which will be described below, included in the paper roll feed cassette 1. The length of the shaft 32 is longer than the width of the paper roll 30. Accordingly, when the paper holder 31 is inserted into the paper roll 30, the shaft 32 projects from both side surfaces of the paper roll 30.

The paper holder 31 has a holding portion 33 which is in contact with the inner surface of the paper roll 30 to hold the paper roll 30. The length of the holding portion 33 is shorter than the width of the paper roll 30 such that the side surfaces of the paper roll 30 are exposed when the paper holder 31 is inserted into the paper roll 30.

Figure 4:
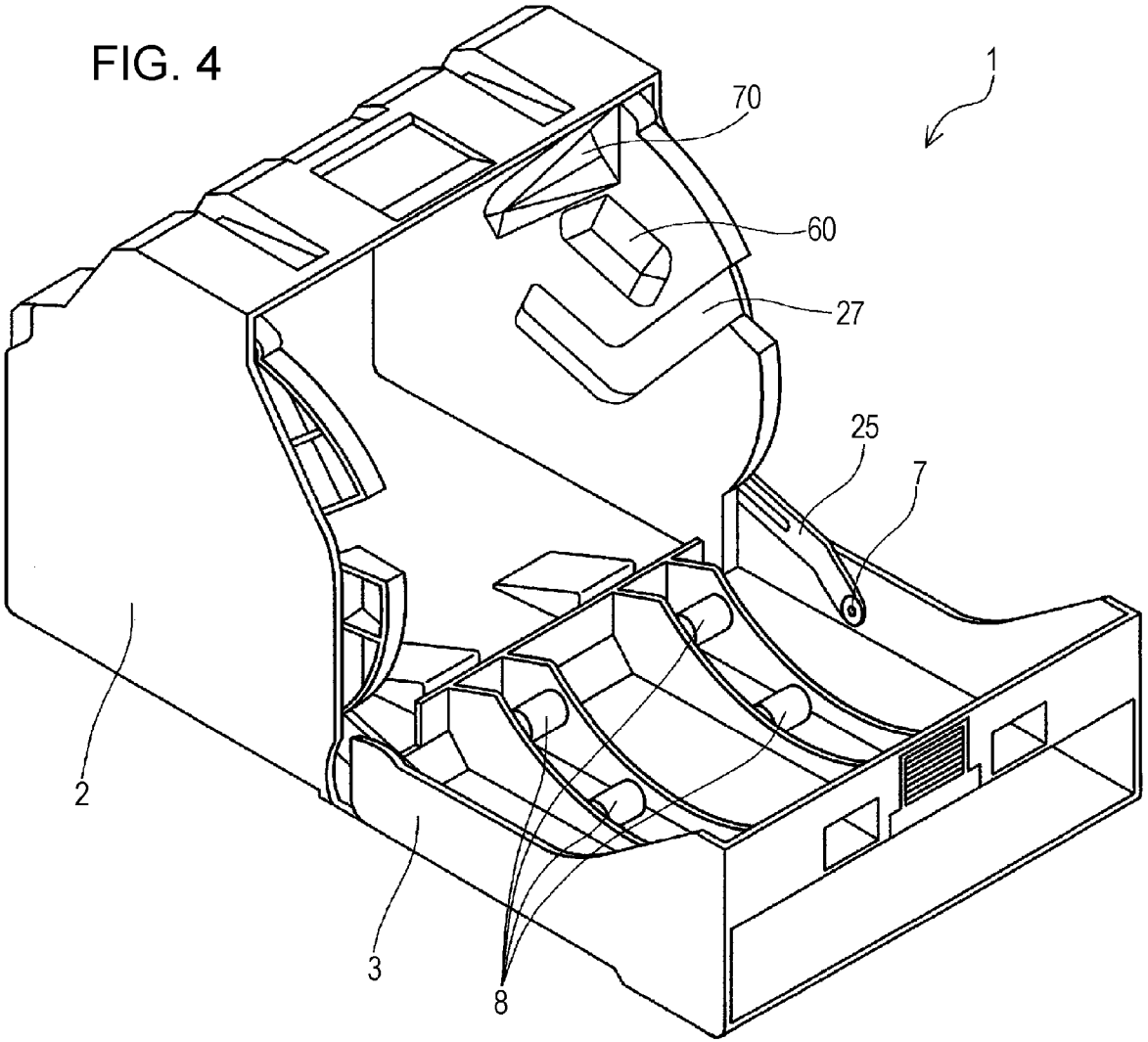
FIG. 4 is a perspective view illustrating a state in which a lid of the paper roll feed cassette according to the present embodiment is opened.

FIG. 4 is a perspective view showing a state in which the lid 3 of the paper roll feed cassette 1 according to the present embodiment is opened.

Figure 5:
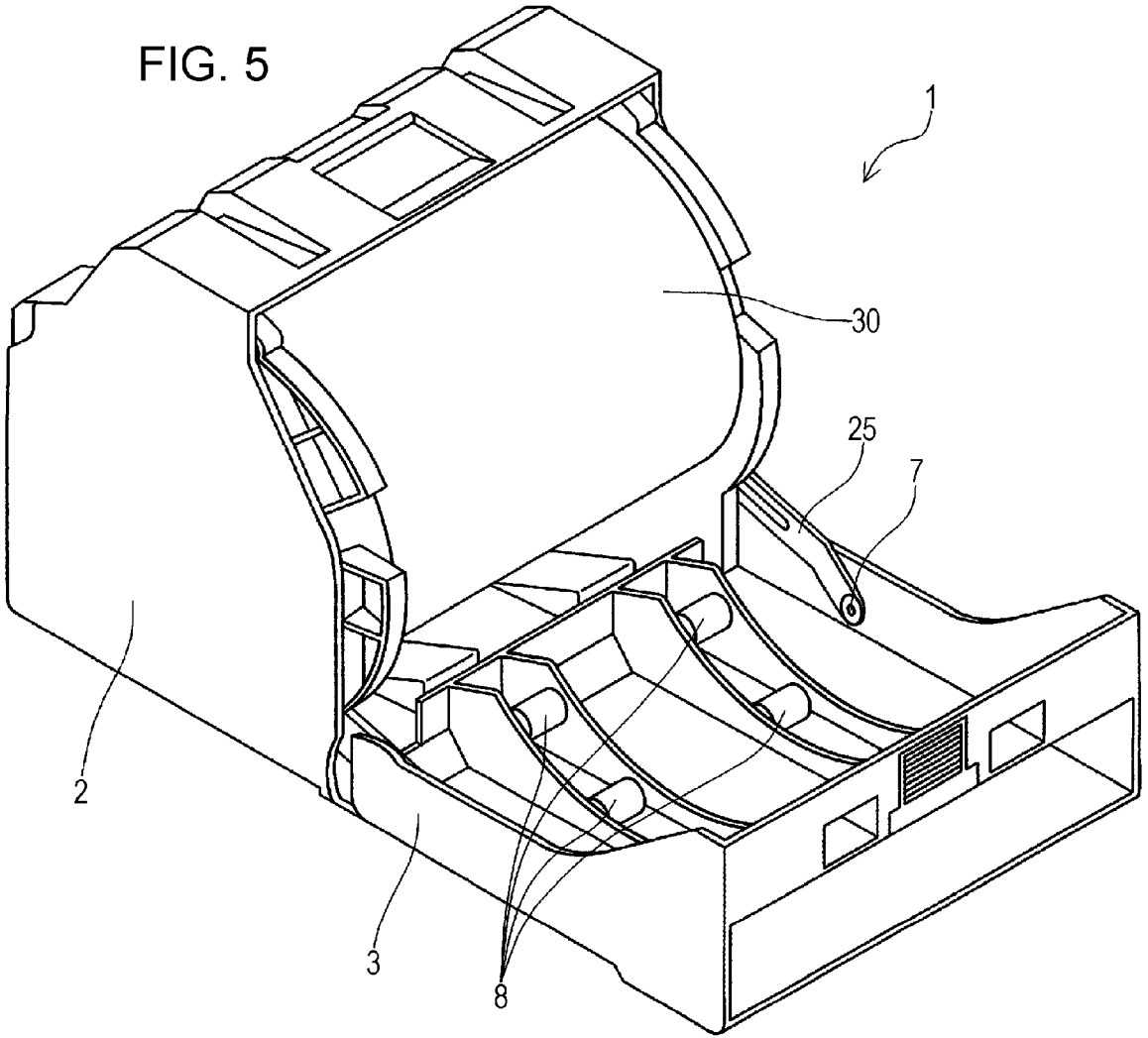
FIG. 5 is a perspective view showing a state in which the paper roll is received in a cassette body of the paper roll feed cassette shown in FIG. 4.

FIG. 5 is a perspective view showing a state in which the paper roll 30 is received in the cassette body 2 of the paper roll feed cassette 1 shown in FIG. 4.

Figure 6:
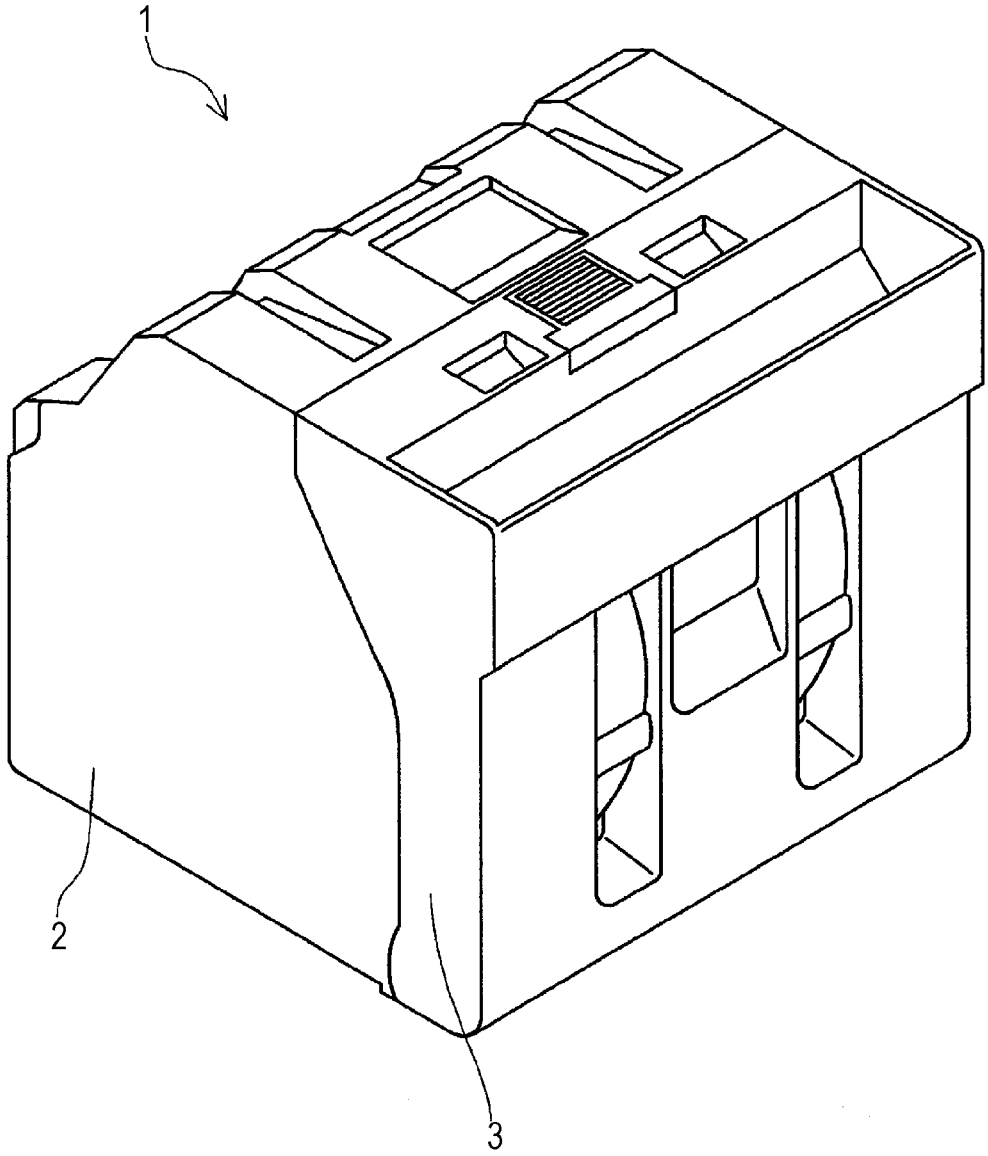
FIG. 6 is a perspective view illustrating a state in which the lid of the paper roll feed cassette is closed.

FIG. 6 is a perspective view showing a state in which the lid 3 of the paper roll feed cassette 1 is closed.

Referring to FIGS. 4 and 5, the lid 3 is rotatable such that each arm 25 is pivoted about a connecting portion 7. When the lid 3 is rotated upward, the cassette body 2 is closed with the lid 3 as shown in FIG. 6.

Referring to FIG. 4, the inner side surfaces of the cassette body 2 each have a holder groove 27. These holder grooves 27 serve as part of the supporting mechanism for supporting the paper roll 30 shown in FIG. 5 and rotatably support the shaft 32 (refer to FIG. 3). The inner side surfaces of the cassette body 2 each also have an anti-loosening member 60 and a skew correcting member 70. The anti-loosening members 60 prevent the paper roll 30 from loosening. The skew correcting members 70 allow the paper of the paper roll 30 to be unwound and drawn straight. The members 60 and 70 will be described below.

Accordingly, when the lid 3 is opened as shown in FIG. 4 and the shaft 32 (refer to FIG. 3) is inserted into the holder grooves 27, the paper roll 30 is received in the cassette body 2 as shown in FIG. 5. When the lid 3 is closed, the whole of the paper roll 30 is covered with the cassette body 2 and the lid 3 as shown in FIG. 6. The paper roll feed cassette 1 is ready to be mounted to a thermal printer. Referring to FIGS. 4 and 5, four rollers 8 are arranged on the inner surface of the lid 3 so as to prevent the inner surface of the lid 3 from being brought into contact with the outer surface of the paper roll 30 to hinder the rotation of the paper roll 30 when the lid 3 is closed.

Figure 7:
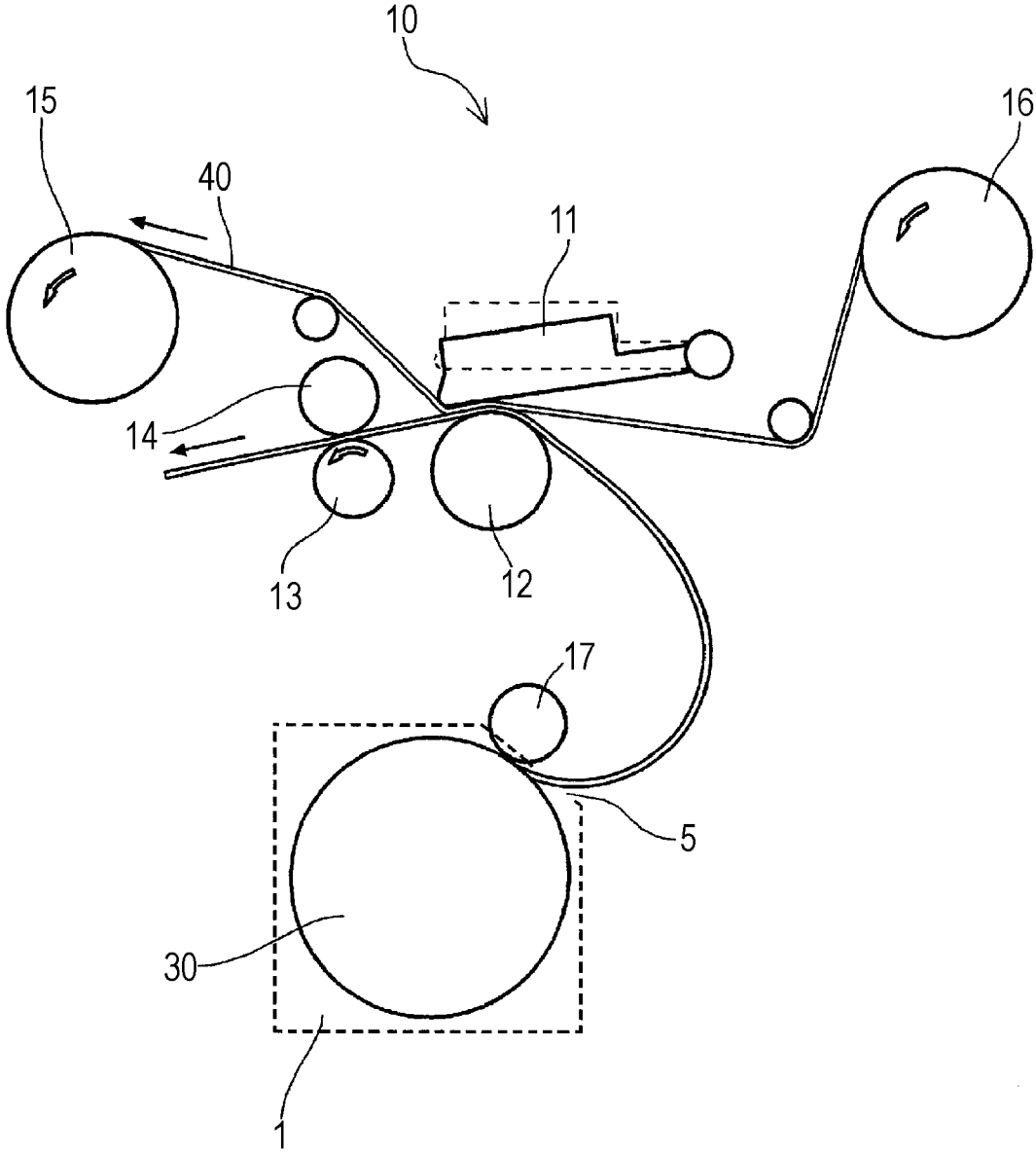
FIG. 7 is a schematic diagram showing the internal structure of the thermal printer mounting the paper roll feed cassette according to the present embodiment.

FIG. 7 is a schematic diagram of the interior of a thermal printer 10 mounting the paper roll feed cassette 1 according to the present embodiment.

Referring to FIG. 7, the paper roll 30 is received in the paper roll feed cassette 1 arranged inside the thermal printer 10. When the paper roll feed cassette 1 is mounted to the thermal printer 10, the outer surface of the paper roll 30 is pressed into contact with the paper feed rollers 17.

The paper feed rollers 17 arranged inside the thermal printer 10 are made of rubber and each have a self-rotating structure. When the paper feed rollers 17 rotate, paper, serving as the outer surface of the paper roll 30, is unwound and drawn in the lengthwise direction of the paper from the feed opening 5 by friction. The drawn paper having a length necessary for photographic printing is passed through nip between a thermal head 11 and a platen 12 such that the recording surface faces upward and is then conveyed while being sandwiched between a pinch roller 13 and a capstan roller 14.

An ink ribbon 40 is wound on a take-up spool 15 and is also wound on a feed spool 16 such that the ink ribbon 40 is arranged so as to pass through nip between the thermal head 11 and the platen 12. The take-up spool 15 and the feed spool 16 are rotatably disposed inside the thermal printer 10. The ink ribbon 40 is drawn from the feed spool 16 by the take-up spool 15, which is rotated in response to image data to be printed, and is wound on the take-up spool 15.

The thermal head 11 has a plurality of heating elements (heating resistors) arranged in a line along the widthwise direction of the paper roll 30. Upon non-printing, the thermal head 11 is moved upward and is disposed slightly away from the platen 12. When a printing instruction is given in this state, the thermal head 11 is moved downward and is pressed toward the platen 12 such that the ink ribbon 40 and the paper unwound from the paper roll 30 are sandwiched between the arrangement of the heating elements of the thermal head 11 and the platen 12. In other words, the heating elements of the thermal head 11 are pressed against the recording surface of the paper on the platen 12, with the ink ribbon 40 therebetween.

When image data is input, the pinch roller 13 is rotated, thus sequentially conveying the paper drawn from the paper roll 30. Further, the take-up spool 15 is rotated, thus sequentially winding the ink ribbon 40 at the same rotational speed as that of the paper roll 30. Simultaneously, the heating elements arranged on the thermal head 11 are selectively energized in response to a control signal, so that thermal energy is applied from the heating elements to the ink ribbon 40. Consequently, a solid ink applied on the ink ribbon 40 is transferred to the paper drawn from the paper roll 30 in accordance with the amount of heat generated from the heating elements of the thermal head 11, thus printing an image. The printed paper is cut into a sheet by a cutter (not shown) and the cut sheet is ejected from an ejection opening.

Printing on paper unwound from the paper roll 30 is performed as described above. It is, therefore, necessary to stably convey the paper drawn from the paper roll 30 during printing. For this purpose, the following paper roll feed mechanism is desired. The desired paper roll feed mechanism holds a constant contact pressure of each paper feed roller 17 applied to the outer surface of the paper roll 30 irrespective of the weight of the paper roll 30, a change in outer diameter of the paper roll 30 accompanied with printing, the width of paper, and a material of paper, thus stabilizing the torque of each paper feed roller 17. In addition, it is important for the paper roll feed mechanism to convey paper drawn from the paper roll 30 straight with reliability without skewing the paper.

Figure 8:
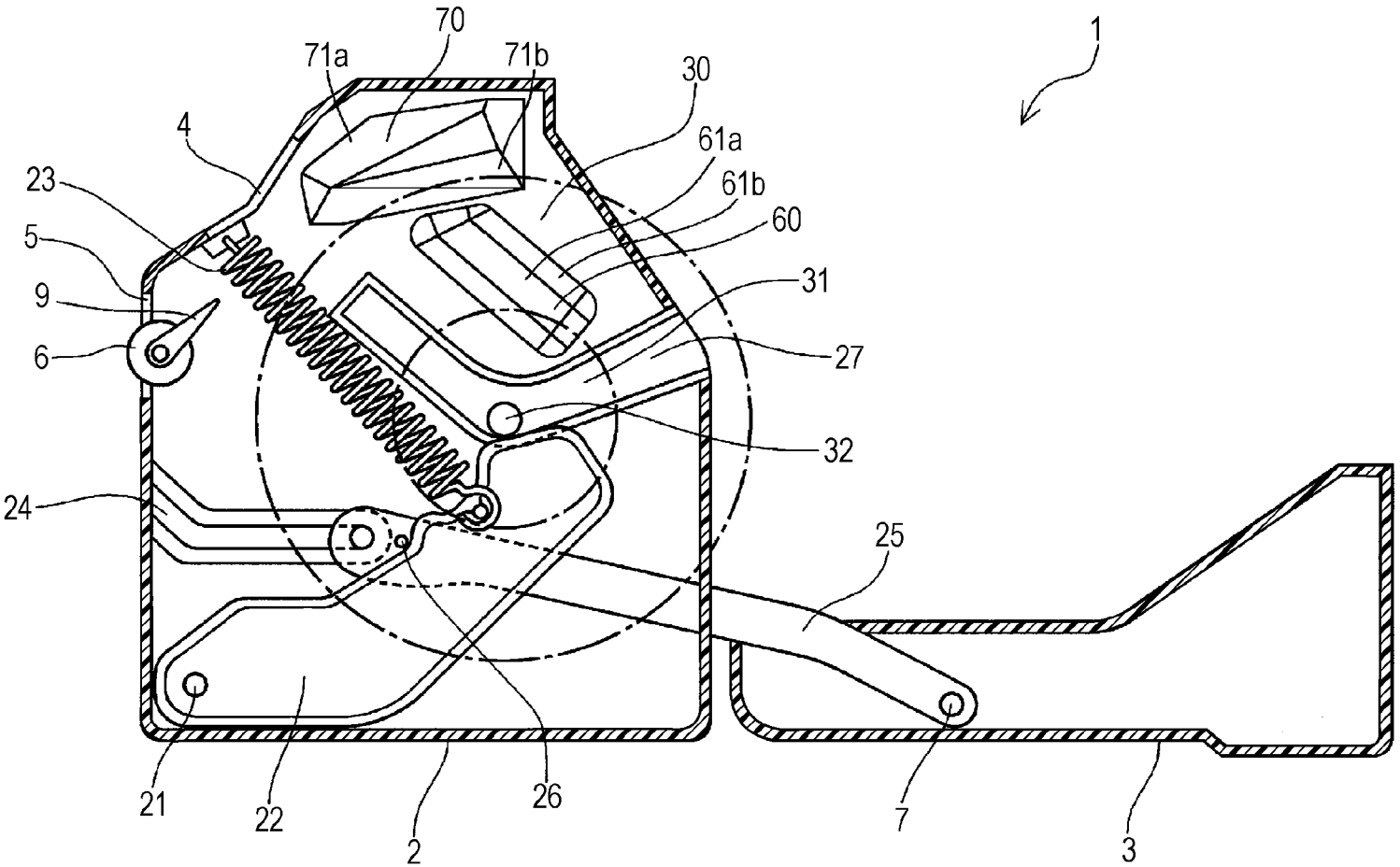
FIG. 8 is a cross-sectional view showing a state in which the lid of the paper roll feed cassette according to the present embodiment is opened.

FIG. 8 is a cross-sectional view showing a state in which the lid 3 of the paper roll feed cassette 1 according to the present embodiment is opened.

Figure 9:
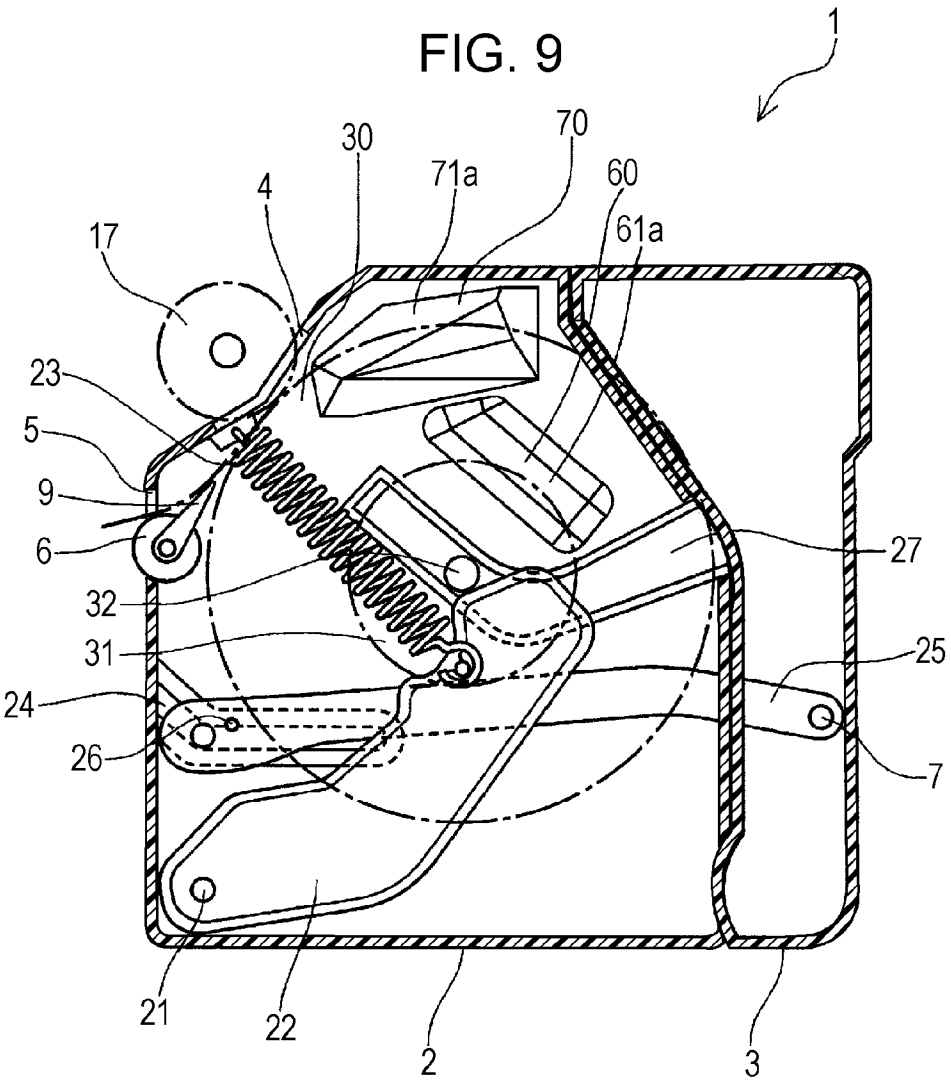
FIG. 9 is a cross-sectional view illustrating a state in which the lid of the paper roll feed cassette shown in FIG. 8 is closed, FIG. 9 showing an initial state of the paper roll upon starting use of the paper roll.

FIG. 9 is a cross-sectional view showing a state in which the lid 3 of the paper roll feed cassette 1 shown in FIG. 8 is closed. FIG. 9 illustrates an initial state of the paper roll 30 upon starting use of the paper roll 30.

Figure 10:
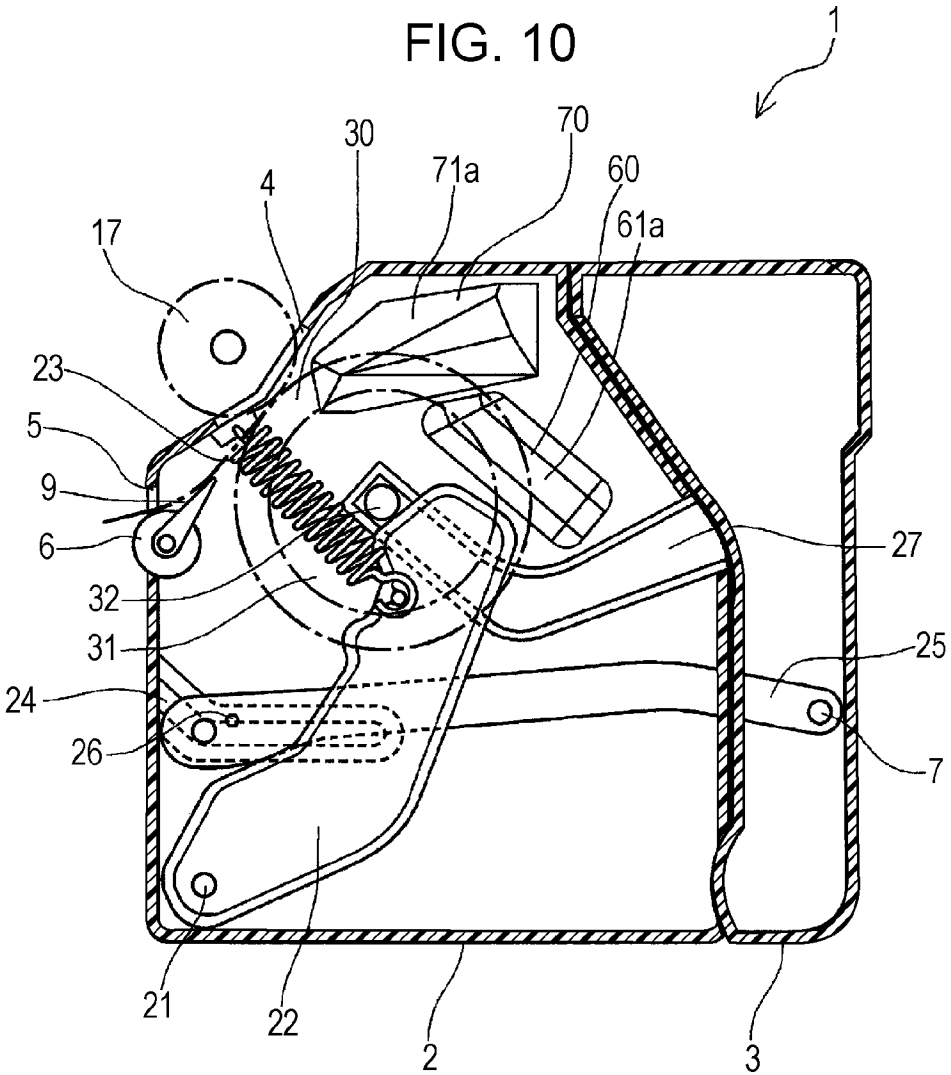
FIG. 10 is a cross-sectional view showing a state in which the lid of the paper roll feed cassette shown in FIG. 8 is closed, FIG. 10 illustrating the consumed state of the paper roll.

FIG. 10 is a cross-sectional view showing another state in which the lid 3 of the paper roll feed cassette 1 shown in FIG. 8 is closed. FIG. 10 illustrates the consumed state of the paper roll 30.

Referring to FIGS. 8 to 10, the paper holder 31 is inserted into the paper roll 30 received in the paper roll feed cassette 1.

As shown in FIG. 3, the paper roll 30 includes recording paper wound in a cylindrical shape with no winding core such that the back of the paper serves as a recording surface. The paper holder 31 is inserted through the hole defining the inner surface of the paper roll 30. The shaft 32 of the paper holder 31 can be fitted into the holder grooves 27 (constituting the supporting mechanism according to the embodiment of the present invention) arranged in the cassette body 2.

The holder grooves 27 are symmetrically V-shaped so that the shaft 32 is moved parallel to the horizontal direction inside the cassette body 2. Each holder groove 27 has a downgrade portion, which the shaft 32 is inserted into, and an upgrade portion corresponding to a segment extending from a bending portion of the V-shaped holder groove 27 to the bottom thereof, the upgrade portion being close to the openings 4.

The paper roll feed cassette 1 has therein support members 22 (constituting the supporting mechanism according to the present embodiment of the present invention together with the holder grooves 27) and support springs 23 (constituting the supporting mechanism together with the holder grooves 27 and the support members 22). Each support member 22 pivots about a fulcrum 21 disposed inside the cassette body 2. Each support spring 23 biases the corresponding support member 22 toward the openings 4, through which the paper feed rollers 17 are pressed into contact with paper.

In addition, the left and right arms 25 are arranged in the interior of the paper roll feed cassette 1. Each of the arms 25 moves along a guide groove 24 in the cassette body 2 to open or close the lid 3. In the opened state of the lid 3 shown in FIG. 8, a pin 26 arranged on each arm 25 is in contact with the upper surface of the associated support member 22 and the weight of the lid 3 coupled to the arms 25 overcomes the biasing force of the support springs 23, thus pushing the support members 22 downward.

The cassette body 2 further has the anti-loosening members 60 and the skew correcting members 70 on the respective inner side surfaces thereof. The anti-loosening members 60 prevent the paper roll 30 from loosening. The skew correcting members 70 allow paper of the paper roll 30 to be unwound and drawn straight from the paper roll 30. Each anti-loosening member 60 presses inner part of the corresponding side surface (i.e., the inner side surface) of the paper roll 30 in the widthwise direction of the paper roll 30. Each skew correcting member 70 presses outer part of the corresponding side surface (i.e., the outer side surface) of the paper roll 30 in the widthwise direction thereof.

Referring to FIG. 8, since the support members 22 are pushed downward by the respective arms 25 in the opened state of the lid 3, the support members 22 do not prevent movement of the paper holder 31 having the shaft 32 whose both ends are inserted in the holder grooves 27. In addition, since each side surface of the paper roll 30 is slid on inclined surfaces 61*b* of the corresponding anti-loosening member 60 and is then pressed by a flat surface 61*a* thereof, the anti-loosening members 60 do not hinder the movement of the paper roll 30. Accordingly, the paper roll 30 is moved under its own weight such that both the ends of the shaft 32 of the paper holder 31 are inserted up to the bending portions of the V-shaped holder grooves 27. Consequently, the paper roll 30 can be easily received in the cassette body 2.

After the paper roll 30 is received as described above, the lid 3 is rotated about the connecting portion 7 of each arm 25, thus closing the lid 3. When the lid 3 is closed, the arms 25 are moved along the respective guide grooves 24 as shown in FIG. 9. Thus, the pin 26 on each arm 25 is separated away from the upper surface of the associated support member 22. Consequently, each support member 22 is pivoted upward by the biasing force of the associated support spring 23, so that the upper end of the support member 22 is moved upward. The upper surface at the upper end of each support member 22 presses the associated end of the shaft 32 of the paper holder 31 upwardly.

The spring constant of each support spring 23 is designed to overcome the initial weight of the paper roll 30 (i.e., the maximum weight thereof before consuming paper of the paper roll 30) and pull the paper roll 30 upward. Accordingly, the support members 22 move the shaft 32 upward such that both the ends of the shaft 32 are inserted into the upgrade portions of the respective V-shaped holder grooves 27. In addition, since each side surface of the paper roll 30 is slid on inclined surfaces 71*b* of the associated skew correcting member 70 and is pressed by a flat surface 71*a* thereof, the skew correcting members 70 do not hinder the movement of the paper roll 30. Consequently, the paper roll 30 is moved upward until the outer surface thereof is brought into contact with the openings 4.

Therefore, when the lid 3 is closed, the outer surface of the paper roll 30 is brought into contact with the openings 4. As described above, the recording surface of paper of the paper roll 30 faces inward (i.e., the back of paper is the recording surface). Even if the outer surface of the paper roll 30 is in contact with the openings 4, there is no problem. When the lid 3 is opened, the respective arms 25 push the support members 22 downward. Consequently, the paper roll 30 is moved to the bending portions (lowest portions) of the V-shaped holder grooves 27 under its own weight, so that the paper roll 30 is free.

FIG. 9 shows a state in which the paper roll feed cassette 1 receiving the paper roll 30 is mounted to the thermal printer. The paper feed rollers 17 arranged in the thermal printer are pressed into contact with the outer surface of the paper roll 30 through the openings 4. Therefore, the paper roll 30 is not in contact with the openings 4. The contact pressure between the paper roll 30 and the paper feed rollers 17 is equivalent to the difference between the biasing force of the support springs 23 based on the spring contact thereof and the weight of the paper roll 30. The contact pressure is approximately fixed.

In other words, the support springs 23 pull the paper roll 30 upward to press the paper roll 30 into contact with the paper feed rollers 17. In this case, as the diameter of the paper roll 30 is larger and the weight thereof is heavier, the support springs 23 extend longer. The biasing force of the support springs 23 is larger as shown in FIG. 9. On the other hand, as the diameter of the paper roll 30 is reduced by consuming paper as shown in FIG. 10, each support spring 23 contracts and the length thereof is shorten, so that the biasing force thereof is smaller. Simultaneously, the weight of the paper roll 30 is also reduced. The reduction in weight of the paper roll 30 is offset by the reduction in biasing force of the support springs 23. Consequently, the contact pressure is automatically held to a fixed value.

Providing that the contact pressure is fixed, when the paper roll feed cassette 1 is mounted to the thermal printer and the paper feed rollers 17 are rotated, the paper roll 30 is stably rotated inside the paper roll feed cassette 1 by the predetermined torque of the paper feed rollers 17. Consequently, paper unwound from the paper roll 30 is drawn and fed through the feed opening 5.

Referring to FIGS. 9 and 10, the cleaner 6 is attached to the feed opening 5 of the cassette body 2. The cleaner 6 has a flap 9 that stands in the direction opposite to the direction of drawing the leading edge of paper, unwound from the paper roll 30, from the feed opening 5 counterclockwise. When the paper roll 30 is rotated counterclockwise by the rotation of the paper feed rollers 17, therefore, the leading edge of paper of the paper roll 30 is caught by the flap 9. The leading edge of the paper is automatically drawn from the feed opening 5 while the recording surface of the paper is being cleaned by the cleaner 6.

To avoid deformation of paper of the paper roll 30 left in the thermal printer except during paper feeding and prevent foreign matter, such as dust outside the paper roll feed cassette 1, from adhering to the paper roll 30, the paper feed rollers 17 are rotated reversely to wind the paper, ejected through the feed opening 5, on the paper roll 30. If the paper roll 30 is rotated in the cassette body 2, the recording surface is not soiled by the rollers 8 (see FIG. 5) or the paper feed rollers 17 because the back of the paper is the recording surface. If the paper is soiled, the cleaner 6 is brought into contact with the recording surface of paper of the paper roll 30 when the paper is drawn from the feed opening 5, so that attached foreign matter is removed.

Moving paper of the paper roll 30 forward and backward from/into the paper roll feed cassette 1 is repeated as described above. Loosening of the paper roll 30 and skewing of paper of the paper roll 30 become problems in this case. In other words, the inner surface of the paper roll 30 is not fixed and the paper holder 31 is inserted in the hole defining the inner surface thereof. Accordingly, paper serving as the inner surface of the paper roll 30 may loosen and/or paper serving as the outer surface thereof may skew by the repeated forward/backward movement of paper of the paper roll 30.

When the paper serving as the inner surface of the paper roll 30 loosens, the paper serving as the outer surface thereof is caused to loosen, thus increasing the outer diameter of the paper roll 30. The paper roll 30 with the increased outer diameter presses on the paper roll feed cassette 1 from within, causing a load during unwinding paper from the paper roll 30. If the frictional resistance is high, paper is not unwound from the paper roll 30, i.e., paper is not drawn from the feed opening 5.

If paper is unwound from the paper roll 30, the paper may skew. The amount of skew gradually increases, causing a problem, such as paper jamming or poor printing. Particularly, the paper roll feed cassette 1 has to include a predetermined clearance in consideration of a variation in the efficiency of receiving the paper roll 30 and a variation in width of the paper roll 30. The clearance, however, is a factor in causing the skew during unwinding paper from the paper roll 30.

Referring to FIGS. 8 to 10, the paper roll feed cassette 1 according to the present embodiment includes the anti-loosening members 60 for preventing the loosening of the paper roll 30 and the skew correcting members 70 for allowing paper of the paper roll 30 to be unwound and drawn straight. Each anti-loosening member 60 includes an inner-side-surface pressing portion and anti-loosening springs (not shown) which bias the inner-side-surface pressing portion toward the corresponding side surface of the paper roll 30. The inner-side-surface pressing portion extends parallel to the upgrade portion of the associated holder groove 27 and includes the flat surface 61*a* and the inclined surfaces 61*b*, which are inclined upward to the flat surface 61*a*. Each skew correcting member 70 includes an outer-side-surface pressing portion and skew correcting springs (not shown) which bias the outer-side-surface pressing portion toward the corresponding side surface of the paper roll 30. The outer-side-surface pressing portion faces a paper unwinding region in the paper roll 30 and includes the flat surface 71*a* and the inclined surfaces 71*b*, which are inclined upward to the flat surface 71*a*.

Figure 11:
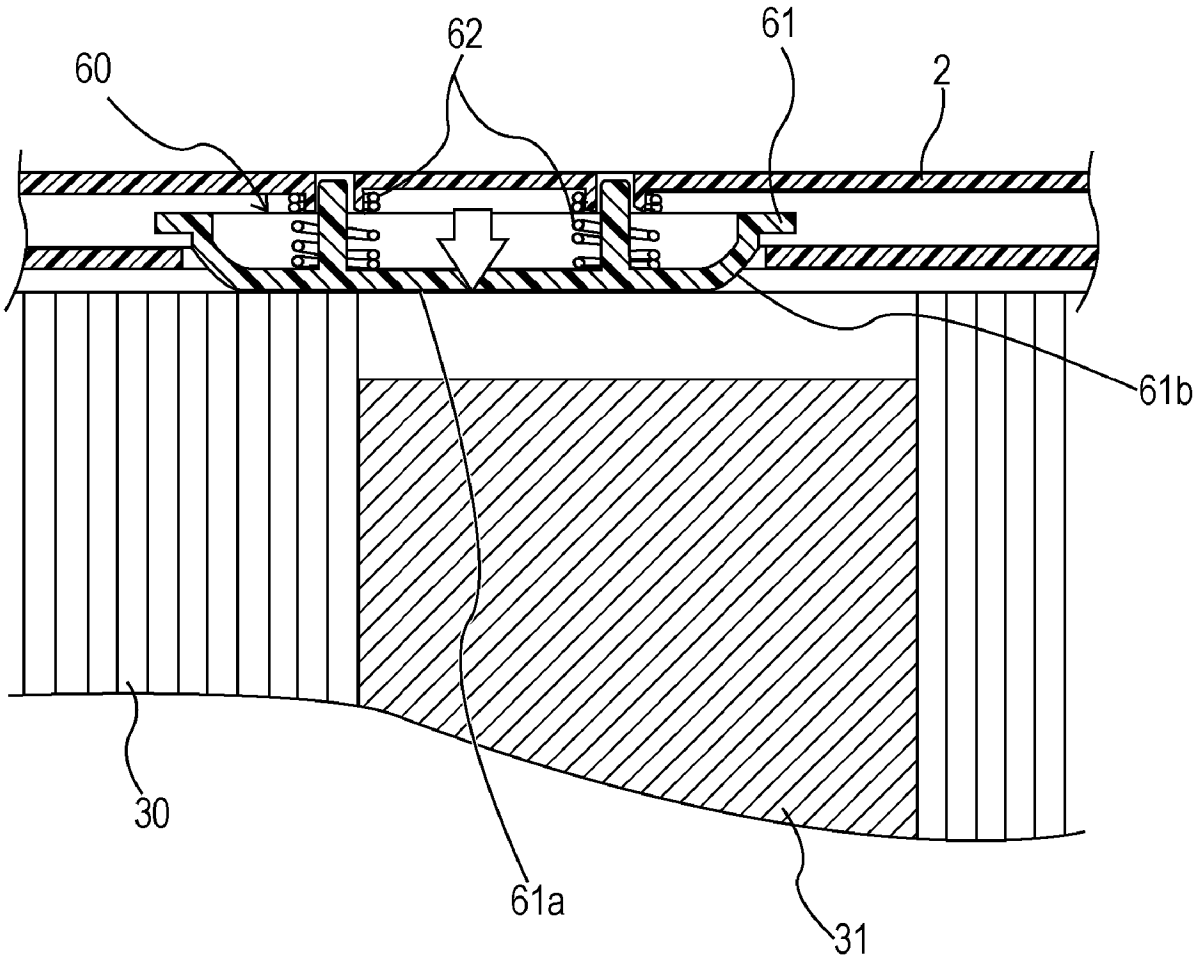
FIG. 11 is a cross-sectional view showing the relationship between an anti-loosening member and the paper roll in the paper roll feed cassette according to the present embodiment.

FIG. 11 is a cross-sectional view showing the relationship between the anti-loosening member 60 and the paper roll 30 in the paper roll feed cassette 1 according to the present embodiment.

Referring to FIG. 11, each anti-loosening member 60 includes an inner-side-surface pressing portion 61 having the flat surface 61*a* and the inclined surfaces 61*b* and two anti-loosening springs 62. The inner-side-surface pressing portion 61 is made of a self-lubricant polyacetal resin having excellent friction and abrasion properties and the flat surface 61*a* and the inclined surfaces 61*b* are smoothed. The anti-loosening springs 62 are low-cost coil springs having stable properties. The material of the inner-side-surface pressing portion 61 and the type of each anti-loosening spring 62 are not intended to be limiting.

The above-described anti-loosening member 60 is arranged in each inner side surface of the cassette body 2. When the paper roll 30 is received in the cassette body 2, the anti-loosening springs 62 urge the inner-side-surface pressing portion 61 such that the flat surface 61*a* is pressed against the associated inner side surface, just above the paper holder 31, of the paper roll 30 in the widthwise direction of the paper roll 30 shown by the downward arrow in FIG. 11. When the paper holder 31 is disposed in the paper roll 30, the inner side surfaces of the paper roll 30 are exposed. Accordingly, each inner-side-surface pressing portion 61 is not pressed on the corresponding side surface of the paper holder 31.

In addition, each inner-side-surface pressing portion 61 extends parallel to part of the associated holder groove 27 (refer to FIGS. 9 and 10). Assuming that the outer diameter of the paper roll 30 is reduced by unwinding paper from the paper roll 30, if the paper roll 30 is moved toward the paper feed rollers 17 (refer to FIGS. 9 and 10), the flat surface 61*a* of each inner-side-surface pressing portion 61 is pressed on the corresponding inner side surface of the paper roll 30 for a period including before and after the movement. Each inner side surface of the paper roll 30, therefore, is continuously pressed from the side.

As described above, a predetermined pressure by the anti-loosening springs 62 is applied to each inner side surface of the paper roll 30 irrespective of the consumed state of the paper roll 30 or the initial diameter of the received paper roll 30. Advantageously, although the paper roll 30 is core-free, inner part of the paper roll 30 can be prevented from loosening. When the paper roll 30 is received in the cassette body 2, the paper roll 30 is slid on the inclined surfaces 61*b* of each inner-side-surface pressing portion 61 and is then pressed by the flat surface 61*a* thereof. Advantageously, the paper roll 30 is not prevented from being received.

Figure 12:
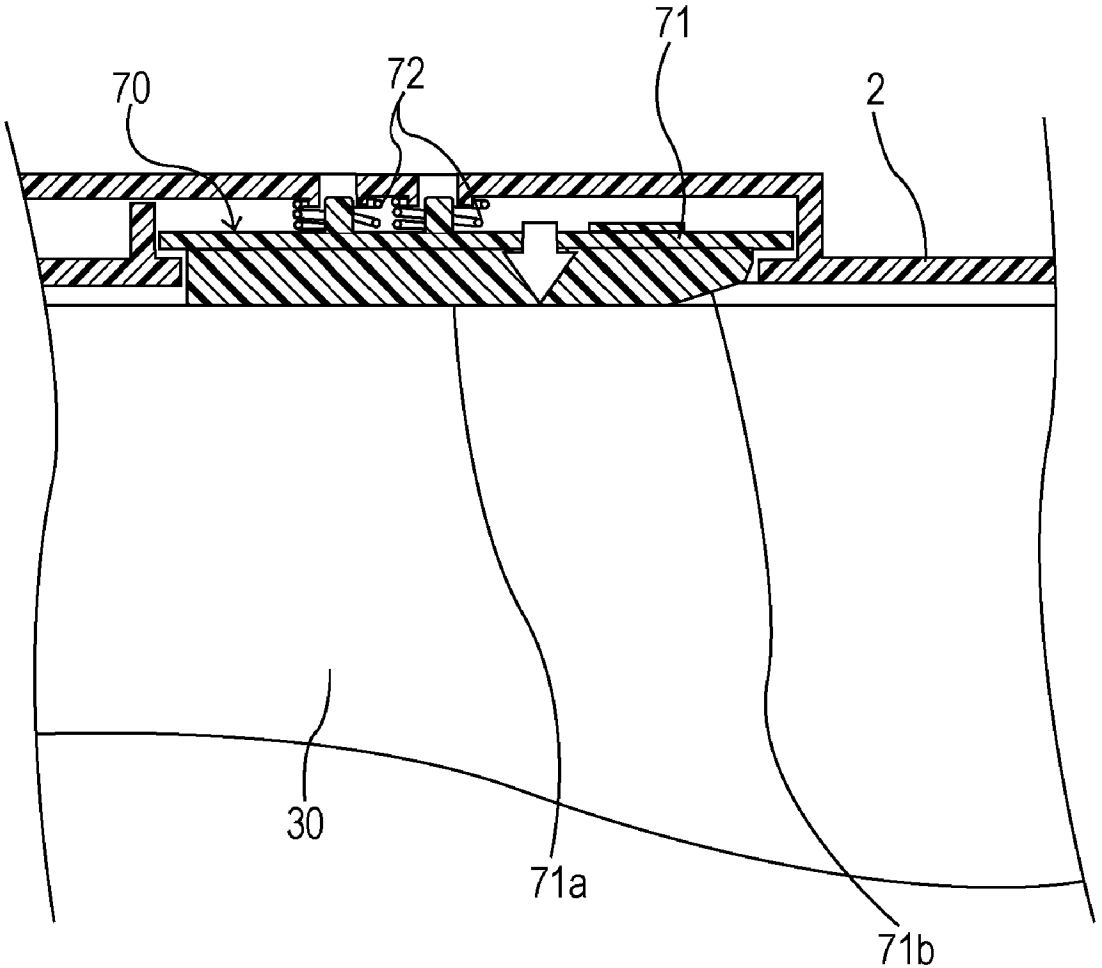
FIG. 12 is a cross-sectional view showing the relationship between an skew correcting member and the paper roll in the paper roll feed cassette according to the present embodiment.

FIG. 12 is a cross-sectional view showing the relationship between the skew correcting member 70 and the paper roll 30 in the paper roll feed cassette 1 according to the present embodiment.

Referring to FIG. 12, each skew correcting member 70 has an outer-side-surface pressing portion 71 having the flat surface 71*a* and the inclined surfaces 71*b* and two skew correcting springs 72. The outer-side-surface pressing portion 71 is made of a self-lubricant polyacetal resin having excellent friction and abrasion properties and the flat surface 71*a* and the inclined surfaces 71*b* are smoothed. The skew correcting springs 72 are low-cost coil springs having stable properties. The material of the outer-side-surface pressing portion 71 and the type of the skew correcting springs 72 are not restricted.

The above-described skew correcting member 70 is disposed in each inner side surface of the cassette body 2. When the paper roll 30 is received, the skew correcting springs 72 urge the outer-side-surface pressing portion 71 such that the flat surface 71*a* is pressed against the associated outer side surface of the paper roll 30 in the widthwise direction of the paper roll 30 (shown by the downward arrow in FIG. 12) in the paper unwinding region of the paper roll 30.

In this instance, the paper unwinding region of the paper roll 30 is an area in the vicinity of paper unwound (the outermost paper separated) from the paper roll 30 by the flap 9 (refer to FIGS. 9 and 10). In the present embodiment, the flat surface 71*a* of each outer-side-surface pressing portion 71 is pressed against the corresponding side surface of the paper roll 30 just before the paper feed rollers 17 (see FIGS. 9 and 10) are pressed into contact with the outer surface of the paper roll 30.

In each outer-side-surface pressing portion 71, the plurality of inclined surfaces 71*b* are inclined upward to the flat surface 71*a* which faces the corresponding side surface of the paper roll 30. The inclined surfaces 71*b* are positioned upstream in the unwinding direction of the paper roll 30 (shown by the leftward arrow in FIG. 12). The flat surface 71*a* is located downstream in the unwinding direction. Accordingly, each outer side surface of the paper roll 30 is smoothly guided through the inclined surfaces 71*b* of the corresponding outer-side-surface pressing portion 71 to the flat surface 71*a* thereof.

Assuming that the outer diameter of the paper roll 30 is reduced by unwinding paper from the paper roll 30, if the paper roll 30 is moved toward the paper feed rollers 17 (see FIGS. 9 and 10), each outer side surface of the paper roll 30 is smoothly guided through the inclined surfaces 71*b* to the flat surface 71*a* and the flat surface 71*a* is pressed against the outer side surface thereof for a period including before and after the movement. Each outer side surfaces of the paper roll 30 is, therefore, continuously pressed from the side.

As described above, a predetermined pressure by the skew correcting springs 72 is applied to each outer side surface of the paper roll 30 irrespective of the consumed state of the paper roll 30 or the initial diameter of the received paper roll 30. Advantageously, paper is unwound from the paper roll 30 while the movement of the paper roll 30 in the widthwise direction thereof is restricted, thus preventing skew of paper of the paper roll 30.

In addition, since the pressure is applied only to the side surfaces of the paper roll 30 before unwinding, any load is not applied to the paper roll 30 while paper is sequentially unwound from the paper roll 30 in association with the consumption of the paper roll 30 and paper to be unwound is shifted from inner part to outer part of the paper roll 30. Advantageously, the paper roll 30 can be protected against damage and a load on the paper roll 30 during unwinding can be minimized. When the paper roll 30 is received in the cassette body 2, each side surface of the paper roll 30 is slid on the inclined surfaces 71*b* of the outer-side-surface pressing portion 71 and is then pressed by the flat surface 71*a*. Therefore, the paper roll 30 is not prevented from being received.

Figure 13:
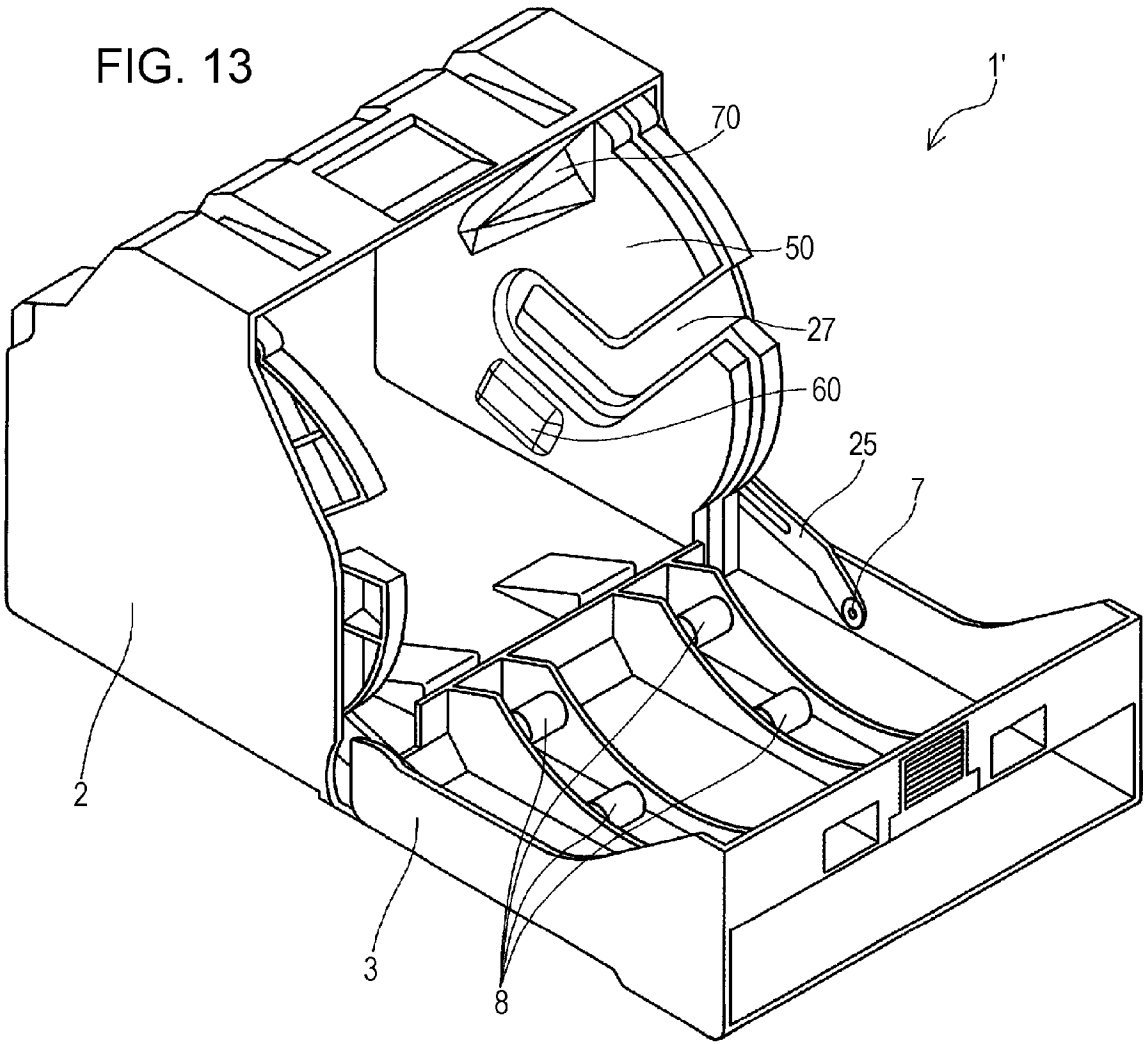
FIG. 13 is a perspective view of a paper roll feed cassette according to another embodiment, FIG. 13 showing a state in which a lid of the paper roll feed cassette is opened and a width adjuster is arranged in the paper roll feed cassette.

FIG. 13 is a perspective view of a paper roll feed cassette 1' according to another embodiment of the present invention, a lid 3 of the paper roll feed cassette 1' being opened, a width adjuster 50 being arranged in the paper roll feed cassette 1'.

Figure 14:
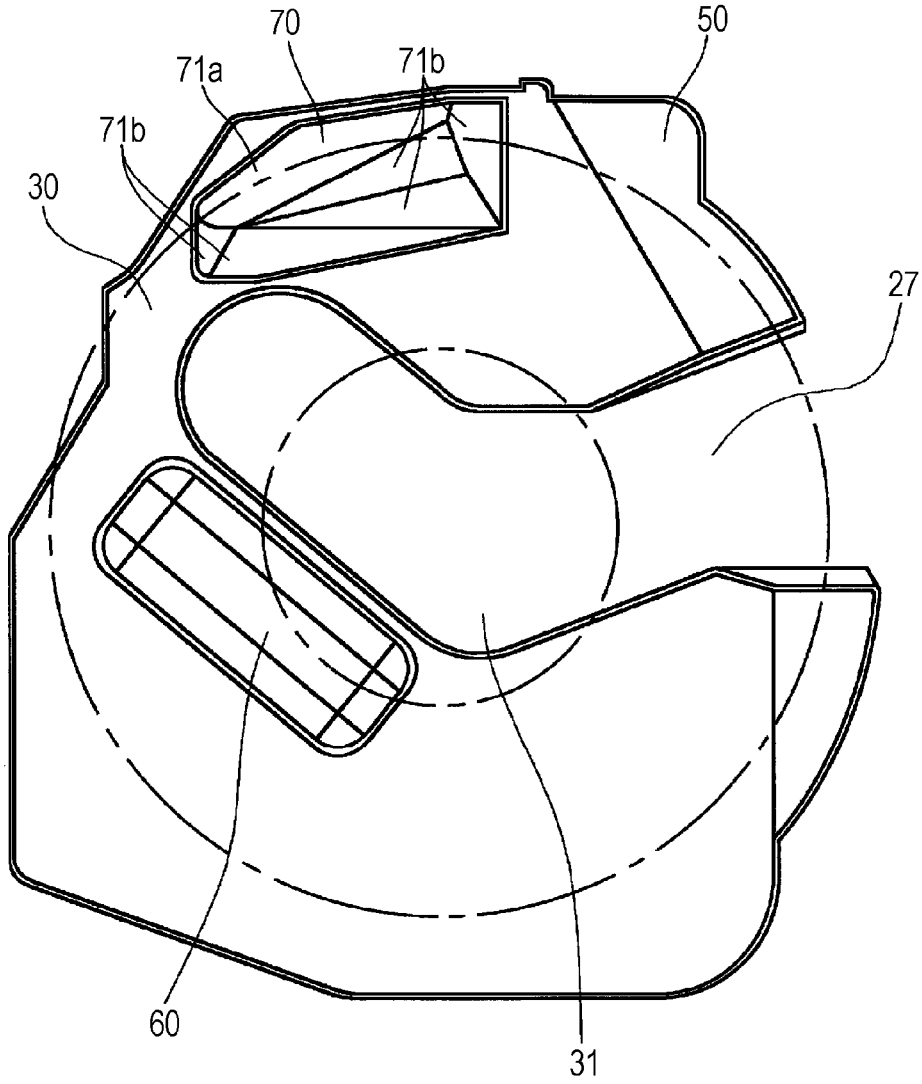
FIG. 14 is a side elevation view showing the relationship between the width adjuster shown in FIG. 13 and a paper roll.

FIG. 14 is a side elevation view showing the relationship between the width adjuster 50 in FIG. 13 and a paper roll 30.

The width adjuster 50 shown in FIGS. 13 and 14 is used so that the paper roll feed cassette 1 according to the foregoing embodiment in FIG. 4 can be adapted for a paper roll 30 having a small width. The width adjuster 50 is a plate-shaped insertable into a cassette body 2.

Referring to FIG. 13, the width adjuster 50 is inserted into the cassette body 2 such that the adapter is located adjacent to one side surface of the cassette body 2. Accordingly, the width of a space for receiving the paper roll 30 in the cassette body 2 can be adjusted by an amount corresponding to the thickness of the width adjuster 50. If two width adjusters 50 are disposed on both the side surfaces of the cassette body 2, respectively, the amount for adjustment can be doubled. Advantageously, the paper roll feed cassette can be adapted to the paper rolls 30 having different widths using the width adjuster 50.

The width adjuster 50 has an anti-loosening member 60 on its inner side surface. Referring to FIG. 14, assuming that the paper roll 30 having a small width is received, the anti-loosening member 60 presses the corresponding inner side surface, just above a paper holder 31, of the paper roll 30 in the widthwise direction of the paper roll 30 (in the direction perpendicular to the drawing sheet of FIG. 14).

The anti-loosening member 60 extends parallel to part of a holder groove 27. If the outer diameter of the paper roll 30 is reduced by unwinding paper from the paper roll 30, a predetermined pressure by the anti-loosening member 60 is applied to the corresponding inner side surface of the paper roll 30. Consequently, inner part of the paper roll 30, which has a small width and includes no winding core, can be prevented from loosening. In the width adjuster 50 shown in FIGS. 13 and 14, the anti-loosening member 60 is located under the holder groove 27. This position is different from that of the anti-loosening member 60 arranged in the cassette body 2 shown in FIG. 4. If the anti-loosening member 60 can press the inner side surface of the paper roll 30, the anti-loosening member 60 may be arranged in any position.

The width adjuster 50 further includes a skew correcting member 70 on its inner side surface. Referring to FIG. 14, in the state in which the paper roll 30 having a small width is received, the skew correcting member 70 presses the corresponding outer side surface of the paper roll 30 in the widthwise direction thereof (in the direction perpendicular to the drawing sheet of FIG. 14) in a paper unwinding region of the paper roll 30.

The skew correcting member 70 is shaped such that a plurality of inclined surfaces 71*b* are inclined upward to a flat surface 71*a* which faces the corresponding side surface of the paper roll 30. Accordingly, the outer side surface of the paper roll 30 is smoothly guided through the inclined surfaces 71*b* to the flat surface 71*a*. If the outer diameter of the paper roll 30 is reduced by unwinding paper from the paper roll 30, a predetermined pressure by the flat surface 71*a* of the skew correcting member 70 is applied to the outer side surface of the paper roll 30. Advantageously, if the paper roll 30 having a small width is received, paper is unwound from the paper roll 30 while the movement of the paper roll 30 in the widthwise direction thereof is restricted, thus preventing skew of paper of the paper roll 30.

As described above, in each of the paper roll feed cassettes 1 and 1' according to the foregoing embodiments, the anti-loosening member 60 can effectively prevent inner part of the paper roll 30 from loosening caused by repeated unwinding and winding of paper from/on the paper roll 30 during printing or vibrations during unwinding/winding.

Particularly, in the core-free paper roll 30, if inner part of the paper roll 30 loosens, the outer diameter of the paper roll 30 is increased as if the paper roll 30 is expanded. If the loosening of outer part of the paper roll 30 is removed, it is difficult to return the increased outer diameter of the paper roll 30 to the original diameter. According to the above-described embodiments, the paper roll feed cassettes 1 and 1' are capable of preventing inner part of the core-free paper roll 30 from loosening.

In the paper roll feed cassettes 1 and 1' according to the embodiments, each skew correcting member 70 prevents skew of paper of the paper roll 30. Even when the paper skews, the skew can be immediately removed. Furthermore, dirt or damage on the paper roll 30 and an increase or variation in load on the paper roll 30 during paper feeding can be minimized. Accordingly, paper jamming or poor printing is not caused.

Having described the embodiments of the present invention, it should be understood that the present invention is not limited to those embodiments and the following various changes and modifications thereof could be made.

(1) In each of the embodiments, the paper roll feed mechanism is applied to the paper roll feed cassette 1 or 1' and the cassette is mounted to the thermal printer 10. The paper roll feed mechanism may be applied to the thermal printer 10. Furthermore, the paper roll feed mechanism may be applied to various image forming apparatuses, such as other printers and a copying machine each using a paper roll 30.

(2) In each of the embodiments, the skew correcting members 70 are arranged on both the inner side surfaces of the cassette body 2 to press both the side surfaces of the paper roll 30. The skew correcting member 70 may be disposed only on one inner side surface. In other words, the arrangement of the skew correcting member 70 may be appropriately determined in consideration of the size or weight of the paper roll 30 and the structure of the cassette body 2. The method of biasing the skew correcting member 70 is not intended to be limiting in any way. An elastically deformable member may be directly attached to the cassette body 2.

(3) In each of the embodiments, the core-free paper roll 30 is used and the paper holder 31 is inserted into the paper roll 30. A paper roll is not limited to the above-described paper roll 30. A paper roll made by winding recording paper on a cylindrical winding core may be used.

It should be understood by those skilled in the art that various modifications, combinations, sub-combinations and alterations may occur depending on design requirements and other factors insofar as they are within the scope of the appended claims or the equivalents thereof.

What is claimed is:

1. A paper roll feed cassette that receives a paper roll including recording paper wound in a cylindrical shape, comprising:

a cassette body for receiving the paper roll;

supporting means for rotatably supporting the paper roll received in the cassette body; and skew correcting means for pressing a side surface of the paper roll, supported by the supporting means, in the widthwise direction of the paper, wherein the skew correcting means presses outer part of the side surface of the paper roll in a paper unwinding region;

the cassette body has at least one opening through which at least one paper feed roller is pressed into contact with the outer surface of the paper roll received in the cassette body, the supporting means has at least one support spring for biasing the outer surface of the paper roll toward the opening and at least one holder groove for guiding the outer surface of the paper roll toward the opening, and the skew correcting means includes an outer-side-surface pressing portion which faces the paper unwinding region and at least one skew correcting spring for urging the outer-side-surface pressing portion against the side surface of the paper roll.

2. The cassette according to claim 1, wherein the outer-side-surface pressing portion of the skew correcting means has a flat surface which faces the side surface of the paper roll and inclined surfaces inclined upward to the flat surface, and the inclined surfaces are positioned upstream in the paper unwinding direction and the flat surface is located downstream in the paper unwinding direction.

3. The cassette according to claim 1, wherein the supporting means and the skew correcting means are arranged on at least one inner side surface of the cassette body.

4. The cassette according to claim 1, further comprising:

a width adjuster disposed on an inner side surface of the cassette body, wherein the supporting means and the skew correcting means are arranged on the inner side surface of the width adjuster.

5. The apparatus according to claim 4, wherein the apparatus is capable of mounting a roll paper feed cassette, the roll paper feed cassette includes:

a cassette body for receiving the paper roll;

at least one opening through which the paper feed roller is pressed into contact with the outer surface of the paper roll received in the cassette body; and a feed opening through which the paper unwound by the paper feed roller is ejected from the cassette body, and the supporting means and the skew correcting means are arranged in at least one inner side surface of the cassette body.

6. The apparatus according to claim 4, wherein the apparatus is capable of mounting a paper roll feed cassette, the paper roll feed cassette includes:

a cassette body for receiving the paper roll;

at least one opening through which the paper feed roller is pressed into contact with the outer surface of the paper roll received in the cassette body;

a feed opening through which the paper unwound by the paper feed roller is ejected from the cassette body; and a width adjuster disposed on an inner side surface of the cassette body, and the supporting means and the skew correcting means are arranged on the inner side surface of the width adjuster.

7. A paper roll feed cassette that receives a paper roll including recording paper wound in a cylindrical shape, comprising:

a cassette body receiving the paper roll;

a supporting mechanism rotatably supporting the paper roll received in the cassette body; and a skew correcting member pressing a side surface of the paper roll supported by the supporting mechanism in the widthwise direction of the paper, wherein the skew correcting member presses outer part of the side surface of the paper roll in a paper unwinding region;

the cassette body has at least one opening through which at least one paper feed roller is pressed into contact with the outer surface of the paper roll received in the cassette body, the supporting mechanism has at least one support spring for biasing the outer surface of the paper roll toward the opening and at least one holder groove for guiding the outer surface of the paper roll toward the opening, and the skew correcting member includes an outer-side-surface pressing portion which faces the paper unwinding region and at least one skew correcting spring for urging the outer-side-surface pressing portion against the side surface of the paper roll.

* * * * *